US005083792A

United States Patent [19]

Radunz et al.

[11] Patent Number: 5,083,792

[45] Date of Patent: Jan. 28, 1992

[54] BOARD GAME APPARATUS

[76] Inventors: William F. Radunz, 3324 S. Field St. #126; Elza M. Sanders, 2042 S. Holland St., both of Lakewood, Colo. 80227

[21] Appl. No.: 585,020

[22] Filed: Sep. 18, 1990

[51] Int. Cl.[5] ..... A63F 3/00

[52] U.S. Cl. ..... 273/248; 273/282

[58] Field of Search ..... 273/241, 242, 243, 248, 273/258, 282

[56] References Cited

U.S. PATENT DOCUMENTS

| | | | |
|---|---|---|---|
| D. 123,508 | 11/1940 | Moore | 273/248 X |
| D. 140,081 | 1/1945 | Gould | 273/248 X |
| D. 150,065 | 6/1948 | Dock | 273/248 X |
| 2,214,167 | 10/1940 | Hohn | 273/282 X |
| 3,065,969 | 11/1962 | Jennens | 273/282 X |
| 3,148,886 | 9/1964 | Sharp | 273/248 X |
| 3,166,325 | 1/1965 | First | 273/248 X |
| 3,395,922 | 8/1968 | Garangiotis | 273/248 |
| 3,804,416 | 4/1974 | Jones et al. | 273/248 |

*Primary Examiner*—Edward M. Coven
*Assistant Examiner*—William E. Stoll
*Attorney, Agent, or Firm*—Leon Gilden

[57] ABSTRACT

An apparatus including a circuitous path arranged about a board originating from a home base and terminating at an objective base for each of four such home and objective bases. The tokens are of a generally paddle shaped configuration and received within apertures about the circuitous path and directed about the circuitous path by utilizing a bridge-path deck of cards to provide the chance relationship between the cards and the tokens to effect movement of the tokens about the path.

1 Claim, 2 Drawing Sheets

BOARD GAME APPARATUS

BACKGROUND OF THE INVENTION

1. Field of the Invention

The field of invention relates to board game apparatus, and more particularly pertains to a new and improved board game apparatus wherein the same provides apparatus for directing tokens about a path and further provides organization for storage of the unit during periods of non-use.

2. Description of the Prior Art

Board game apparatus of various types have been utilized in the prior art to direct tokens about a path throughout the board of the organization. Such apparatus may be found in U.S. Pat. No. 3,395,922 to Garangiotis wherein the board game includes a path of recesses to receive spheres therewithin, with the spheres directed about the path by a deck of cards.

U.S. Pat. No. 4,131,281 to Taylor sets forth a board game of a generally octagonal configuration utilizing four game zones, each zone having a storage zone, a starting zone and a playing zone and a central die agitating device.

U.S. Pat. No. 4,119,321 to Creel sets forth a board game utilizing various tokens for directing the tokens about the board game by utilizing a dice member.

U.S. Pat. No. 3,589,728 to McFarland sets forth another example of a board game apparatus utilizing tokens directed about the board game, with movement directed by a transparent elongate column containing a plurality of various colored balls therewithin.

U.S. Pat. No. 2,531,510 to Heacock sets forth a board member utilizing tokens for directing the tokens about the board member in use.

As such, there continues to be a need for a new and improved board game apparatus which addresses both the problems of ease of use as well as convenience in transport and storage thereof and in this respect, the present invention substantially fulfills this need.

SUMMARY OF THE INVENTION

In view of the foregoing disadvantages inherent in the known types of board game apparatus now present in the prior art, the present invention provides a board game apparatus wherein the same provides a board game and associated apertures for receiving tokens, wherein the apertures and tokens are arranged to permit movement of the tokens throughout a path defined by the apertures and subsequently permit securement of the tokens relative to the aperatures for storage and transport of the organization. As such, the general purpose of the present invention, which will be described subsequently in greater detail, is to provide a new and improved board game apparatus which has all the advantages of the prior art board game apparatus and none of the disadvantages.

To attain this, the present invention provides an apparatus including a circuitous path arranged about a board originating from a home base and terminating at an objective base for each of four such home and objective bases. The tokens are of a generally paddle shaped configuration and received within apertures about the circuitous path and directed about the circuitous path by utilizing a bridge-path deck of cards to provide the chance relationship between the cards and the tokens to effect movement of the tokens about the path.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game apparatus which has all the advantages of the prior art board game apparatus and none of the disadvantages.

It is another object of the present invention to provide a new and improved board game apparatus which may be easily and efficiently manufactured and marketed.

It is a further object of the present invention to provide a new and improved board game apparatus which is of a durable and reliable construction.

An even further object of the present invention is to provide a new and improved board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new and improved board game apparatus which provides in the apparatuses and methods of the prior art some of the advantages thereof, while simultaneously overcoming some of the disadvantages normally associated therewith.

Still another object of the present invention is to provide a new and improved board game apparatus wherein the same sets forth a structure for ease of manipulation of the tokens throughout the board game during use and permits subsequent convenience of storage and transport of the organization during periods of non-use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
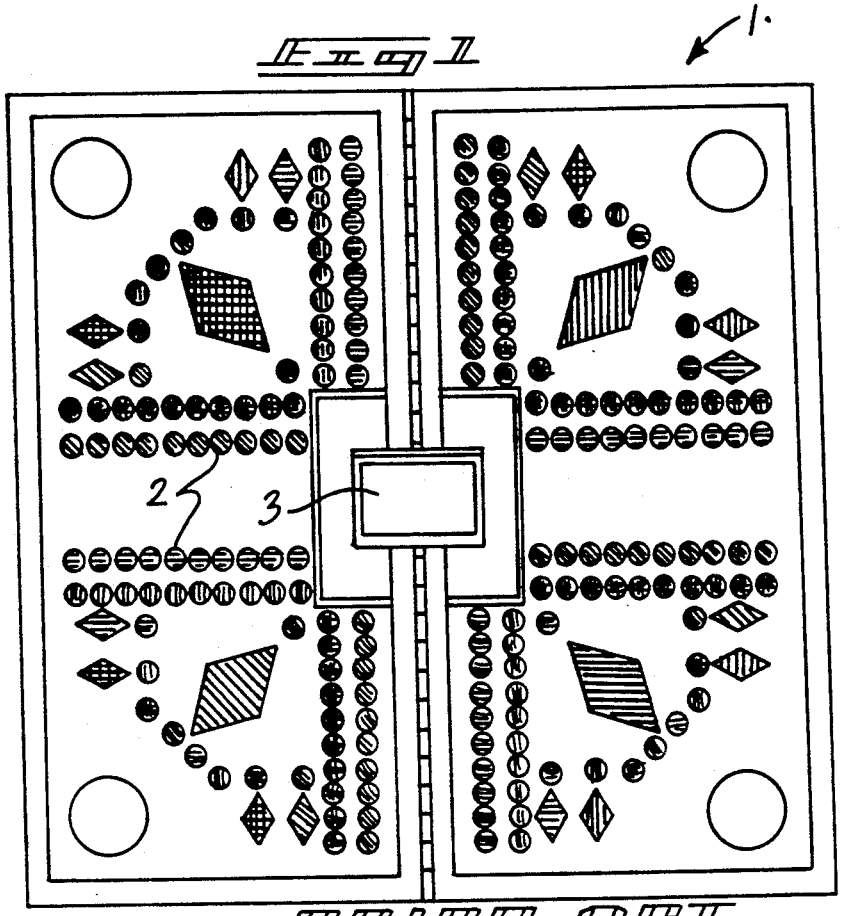
FIG. 1 is a top orthographic view of a prior art board game organization.

With reference now to the drawings, and in particular to FIGS. 1 to 6 thereof, a new and improved board game apparatus embodying the principles and concepts of the present invention and generally designated by the reference numeral 10 will be described.

FIG. 1 illustrates a prior art board game 1, wherein a path of recesses 2 defines a circuitous path about the playing board, wherein the use of playing cards 3 mounted upon a tray medially of the board game permit directing of the tokens.

More specifically, the board game apparatus 10 of the instant invention essentially comprises a playing board formed of a polymeric or cellular material, including a top surface 11. The top surface 11 includes a circuitous path 17 of a generally cross-shaped configuration, including a respective first, second, third, and fourth starting home base 12, 13, 14, and 15 respectively. Each home base is defined by a predetermined number of apertures to include a predetermined number of tokens thereon. Each home base and each series of tokens are of a contrasting coloration. Further, each home base is of a generally "L" shaped configuration with an elongate leg of the "L" terminating in the circuitous cross-shaped path 17 to include an aperture 16 therewithin. The apertures 16 of the circuitous path 17 will be described in more detail below. The circuitous path 17 is defined about a respective first, second, third, and fourth objective base 12*a*, 13*a*, 14*a*, and 15*a*. Each objective base includes a predetermined number of apertures therewithin to receive the respective tokens of each respective home base in a termination of the game.

Figure 5:
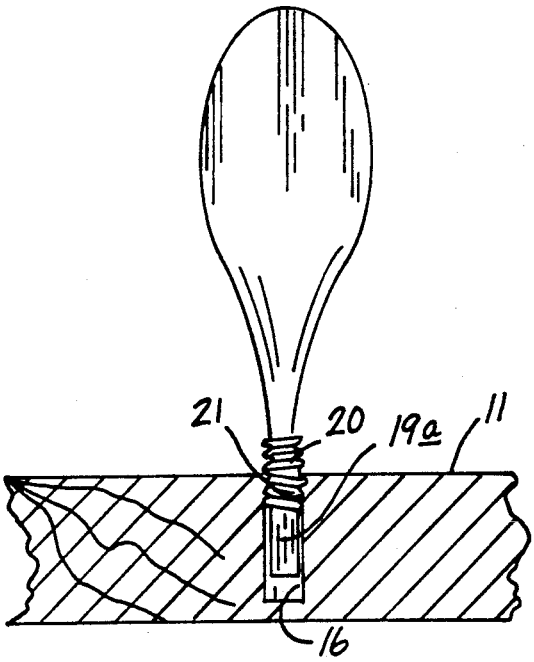
FIG. 5 is an orthographic cross-sectional illustration of the token mounted relative to an associated aperture of the playing board of the instant invention.
Figure 6:
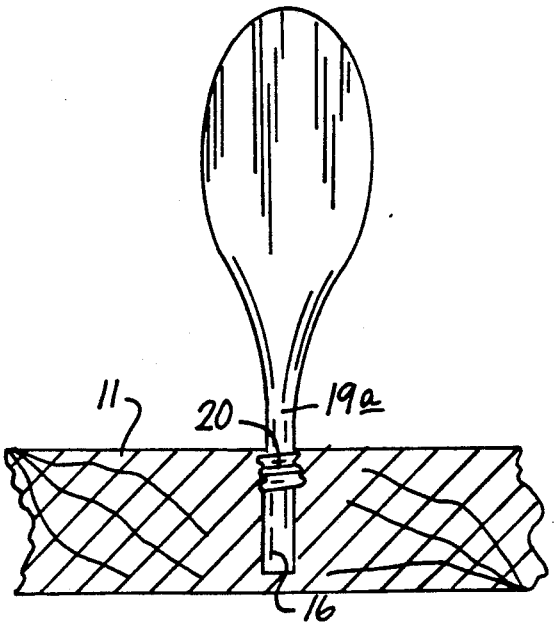
FIG. 6 is an orthographic view, taken in elevation, of the modified token mounted for securement within an associated aperture of the instant invention.

The tokens are defined by paddle shaped tokens 18, including a planar upper blade surface and an elongate coaxially aligned stem 19 of a predetermined length. A modified token 18*a* includes a modified stem 19*a*, with a threaded shank portion adjacent the upper end of the stem 19*a*, with the threaded shank portion extending diametrically beyond the modified shank 19*a*. Each of the apertures 16 is defined by the predetermined length, with the upper terminal end portion of each of the apertures including an internally threaded aperture surface 21 interiorly of the wall of the aperture to complementarily receive the threaded portion 20 therewithin. In this manner, during playing of the game, the modified shank 19*a* is directed within each of the apertures 16, in a manner as illustrated in FIG. 5, and directed about the circuitous path. Each token is merely threaded interiorly of each aperture and received within the apertured surface 21 to secure each of the tokens therewithin in a fixed manner for transport and storage.

Figure 2:
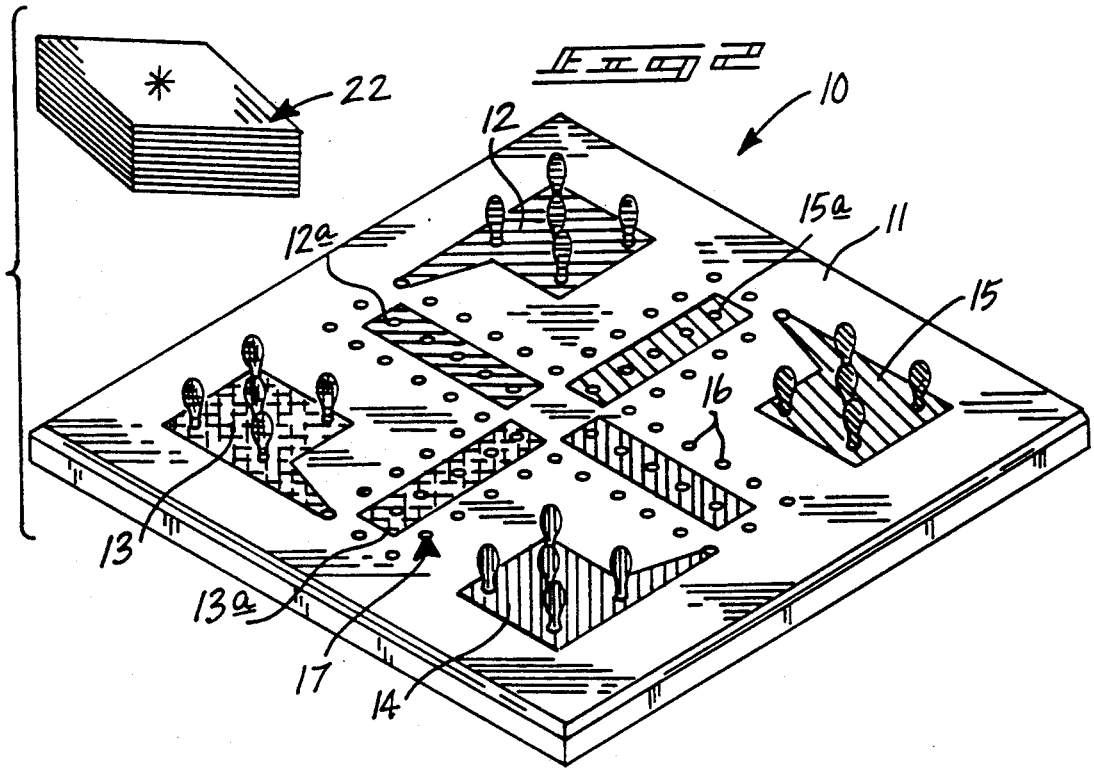
PRIOR ART Fig 2
FIG. 2 is an isometric illustration of the instant invention.
Figure 3:
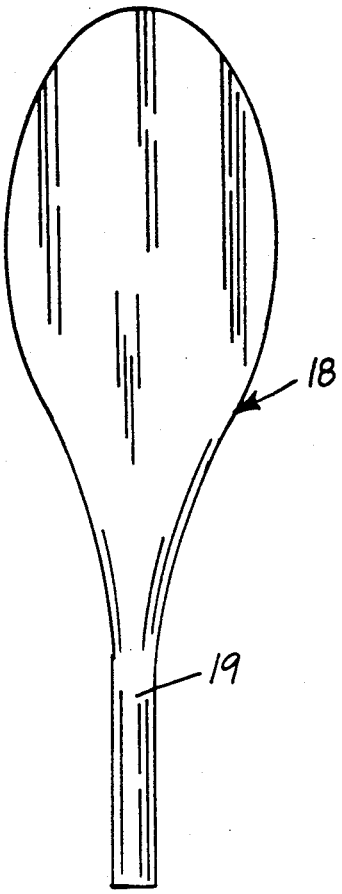
FIG. 3 is an orthographic view, taken in elevation, of the token utilized by the instant invention.
Figure 4:
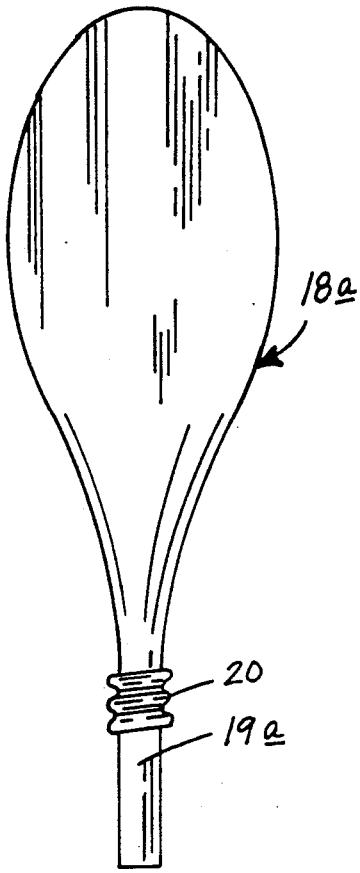
FIG. 4 is an orthographic view, taken in elevation, of a modified token utilized by the board game of the instant invention.

A bridge-type card deck 22, as illustrated in FIG. 2, is utilized to direct play and movement of the tokens about the circuitous path 17. The first player to direct all of the tokens from the home base about the circuitous path into an associated and like coloration of objective base is declared a winner. The card deck, in directing the pieces about the board from the home base, are to be valued as follows:

FOR INDIVIDUAL OR SINGLE PLAYERS

Ace—1 move or get out
2—2
3—3 backup moves only
4—4
5—5
6—6
7—7
8—8
9—9
10—10
Jack—Exchange any of your pieces with any other except home base.
Queen—12
King—Get out only

RULES

1. Cut cards to determine first dealer. High card deals.
   a. Deal proceeds to left
   b. 4 players: deal 5 cards to each player first hand, then 4 each hand thereafter.
   c. 3 players: deal 5 cards to each player first hand, then 4 each hand thereafter, discarding last card of deck.
   d. 2 players: deal 5 cards to each player the first two hands and 4 each hand thereafter.
2. Player to dealers left starts. If player cannot get out with Ace or King, player places all cards face up in front of him/her and is out for that hand. Play passes to the next player to the left. Anytime during the hand a player cannot play they follow the same procedure.
3. If the player has an Ace or King, place card in front of him/her and move one playing piece out of Home Base. Play then passes to the left until the hand is played out.
4. When a player has two playing pieces on the board at the same time, the player can never pass his own token forward or backwards.
5. If a player's piece lands on another player's piece, the player sends that piece back to Home Base.
6. To enter an objective base, the move must be the exact count. The player cannot jump his own pieces.
7. If a player has a token in a home base and and the player's only move is 3, the player must play it and back up 3.

It is also contemplated that with the four home base areas directing each of the tokens into the associated objective base spaces 12*a*–15*a*, that doubles may be utilized, wherein one team of players is positioned to a further team of players utilizing two home bases and two objective bases.

RULES (FOR PLAYER PARTNERS)

1. Ace, 1 move or get out
2. 2, 2
3. 3 backup moves only
4. Same as singles except that you can pass your partner.
5. Same as singles, even if it is your partner. 6 and 7. Same as Singles
8. Once a team member has all their pieces home, their pieces are safe and cannot be moved even if their only play would be a 3 backup. A player may help a partner move utilizing a dealt hand of cards of the deck 22.

ALTERNATE RULES

1. Ace, 1 move or get out
2. 2, 2
3. 3, 3 backup moves only

3a. Advanced doubles differs from Doubles, in that once each player from the same team has one piece out of a home base, a partner can move either color of a team. If a player has a piece sent back to home base he/she can still move the partner's piece. If a team's last card of a dealt hand is a Jack, a team piece must be moved.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A board game apparatus comprising, in combination, a rigid playing board, the playing board including a top surface, the top surface including a first, second, third, and fourth home base area, each home base area including a predetermined number of apertures therewithin, and each home base area including a predetermined number of tokens positioned within the predetermined apertures, and respective first, second, third, and fourth objective base, and a circuitous path directed from each home base area to each objective base, with the first home base area directed to the first objective base, the second home base area directed to the second objective base, the third home base area directed to the third objective base, and the fourth home base area directed to the fourth objective base, and each objective base including a predetermined number of further apertures, wherein the predetermined number of further apertures are equal to the number of predetermined apertures, and each token including an upper end and an elongate stem longitudinally aligned with the upper end, the elongate stem defined by a predetermined length receivable within each of the apertures, and the circuitous path defined by equally spaced path apertures, and wherein each aperture is defined by a predetermined height equal to the predetermined length of the elongate stem, and wherein the elongate stem includes an externally threaded portion positioned adjacent an upper end of the stem, and a spacing defined between the lower end of the threaded portion and the terminal end of the stem and equal to the predetermined height of each aperture, and each aperture includes an internally threaded aperture surface positioned adjacent an upper terminal end of each aperture to complementarily receive the threaded portion of each stem to threadedly secure each stem within an associated aperture.

* * * * *